United States Patent [19]

Lucky

[11] Patent Number: 4,531,440

[45] Date of Patent: Jul. 30, 1985

[54] RADIAL ARM TIMBER SAW AND POWER CONTROLLER THEREFOR

[75] Inventor: Bobby D. Lucky, Athens, Ala.

[73] Assignee: Lucky Manufacturing Co., Huntsville, Ala.

[21] Appl. No.: 360,823

[22] Filed: Mar. 23, 1982

[51] Int. Cl.[3] ..... B27B 7/02

[52] U.S. Cl. ..... 83/471.2; 83/483; 83/490; 83/928

[58] Field of Search ..... 83/490, 484, 483, 471.2, 83/928; 144/3 D

[56] References Cited

U.S. PATENT DOCUMENTS

| | | | |
|---|---|---|---|
| 958,197 | 5/1910 | Todt | 83/490 |
| 2,039,017 | 4/1936 | McLeod | 83/928 X |
| 3,580,306 | 5/1971 | Tanguay | 83/471.2 |
| 3,623,519 | 11/1971 | Radle | 83/471.2 |
| 3,718,060 | 2/1973 | Carlton et al. | 83/928 X |
| 3,832,928 | 9/1974 | Copeland | 83/928 X |

*Primary Examiner*—James M. Meister

*Attorney, Agent, or Firm*—L. Lawton Rogers, III

[57] ABSTRACT

A hydraulically powered mobile radial arm timber saw and control assembly in which positive control of saw movement is maintained from the fully retracted saw position to the fully extended saw position by a novel hydraulic control assembly.

10 Claims, 8 Drawing Figures

10
12
14
16
20
24
26
28
30
32
34

RADIAL ARM TIMBER SAW AND POWER CONTROLLER THEREFOR

BACKGROUND OF THE INVENTION

The present invention relates to timber saws and more particularly to mobile saws for sawing timber into suitable lengths for transportation and use as telegraph poles, pulp wood, and the like.

The desirability of mobile radial arm timber saws is well known. Known saws have utilized trailer mounted radial arm assemblies in which the radial saw is boom mounted and moved horizontally in the cutting operation across timber placed in the bed of the trailer.

Control of the movement of the saw both in the cutting and retracting motions has been a problem with known saws. A hydraulic piston is customarily used to position the saw. This piston must necessarily be attached both to the trailer base as the stationary side of a parallelogram as well as to the saw boom through an appropriate linkage so that the saw boom may form the opposite side of the parallelogram. The force of the hydraulic piston acting on the saw boom moves the parallelogram and then the saw across the trailer bed in the cutting operation.

In known timber saws, there is generally a position adjacent the fully retracted saw position in which control of the saw is not positively maintained. Spring members, generally coil or flat springs, are used to insure that the saw, once in this little or no power position, may continue to move through such position. to either the fully retracted or fully extended positions. Control problems near this point are exacerbated by any wear of the linkage assembly.

In addition to the lack of control over the position of the saw adjacent the fully withdrawn position, the known saw assemblies, once the spring bias is overcome, typically cause the saw to accelerate rapidly across the trailer bed. This initial acceleration in the feed of the saw into the timber may result in "bucking" or stalling of the saw. These and other problems are obviated by the present invention which includes a linkage assembly which insures positive control of the position of the saw boom vis-a-vis trailer bed at all times. This positive control of the saw includes control of the speed of saw movement across the trailer bed.

These and many other advantages will be readily apparent from the claims and from the following detailed description when viewed in connection with the appended drawings.

THE DRAWINGS

THE DETAILED DESCRIPTION

Figures 1, 2, 3:
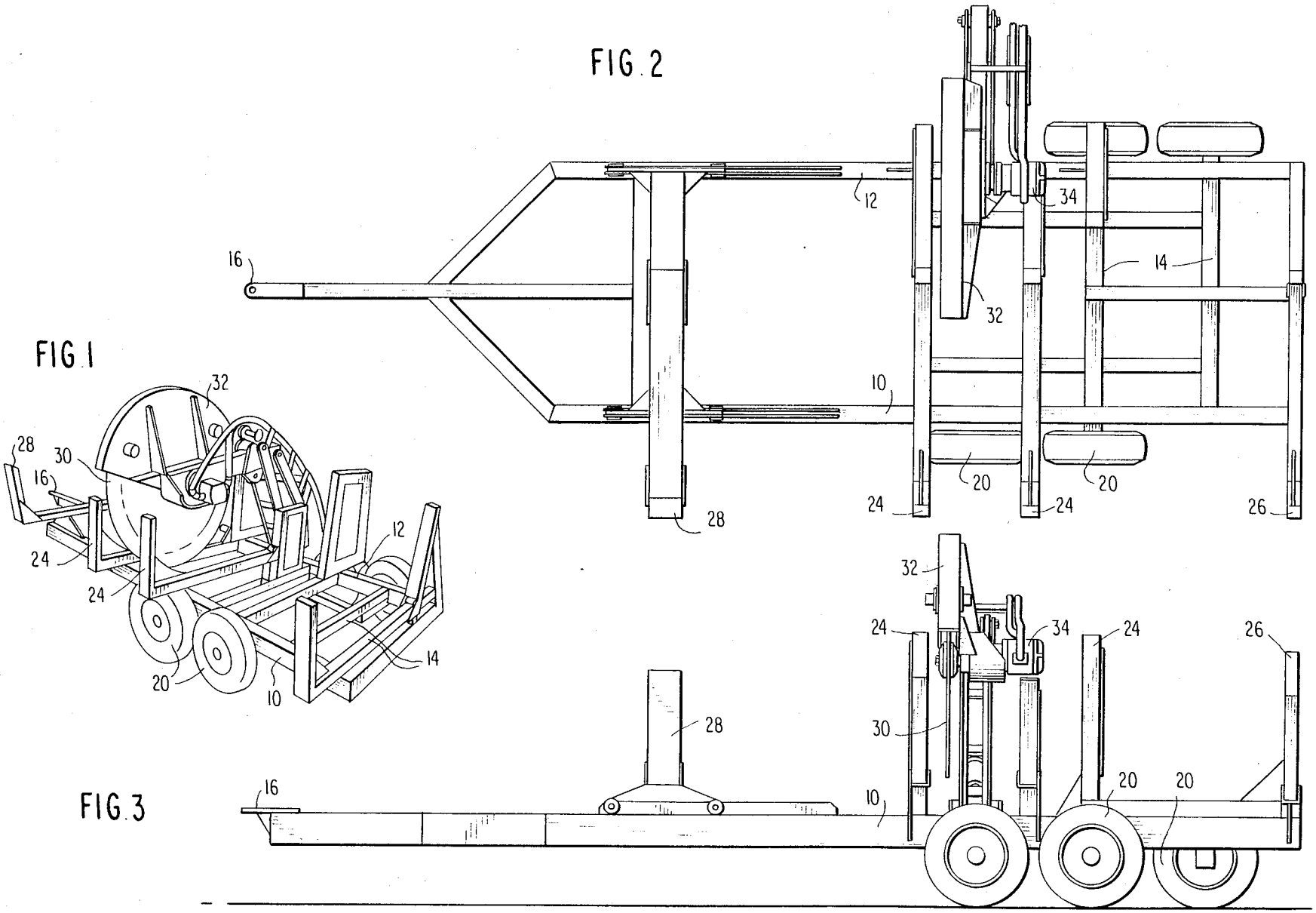
FIG. 1 is a pictorial view of the mobile timber saw of the present invention.
FIG. 2 is a top plan view of the saw of FIG. 1.
FIG. 3 is a left side view of the saw of FIG. 1.

With reference now to FIGS. 1, 2 and 3 where a preferred embodiment of the present invention is illustrated, the mobile saw of the present invention includes a trailer bed comprising a pair of longitudinal members 10 and 12 having a number of spaced horizontal members 14 and a forwardly extended conventional coupling device 16 such as a conventional trailer hitch. The trailer bed is adapted to support a log during the cutting operation and is desirably provided on both lateral sides with a pair of wheels 20. Note that at least one of the wheels 20 is desirably offset with respect to the longitudinal axis of the trailer bed to permit the saw to move to the fully retracted position shown in FIG. 2 without damage to the wheels and to facilitate the machine loading of timber on the trailer bed into area generally indicated as 22 in FIG. 3.

With continued reference to FIGS. 1–3 where like elements have been given like numerical designations, a pair of upright stanchions 24 are provided against which the timber may be pressed during the horizontal movement of the saw in the cutting operation. Additional lateral support may be provided by rear stanchion 26 and by a forward stanchion 28 selectively positionable along the longitudinal members 10 and 12.

The saw blade 30 may be of any suitable conventional type provided with a conventional hood 32 and driven in any conventional manner, e.g. by a suitable conventional hydraulic motor 34. Movement of the saw 30 laterally across the saw bed in the cutting operation is desirably controlled by a double acting hydraulic piston and cylinder and associated linkage hereinafter described in more detail in connection with FIGS. 6 and 7.

Figure 4:
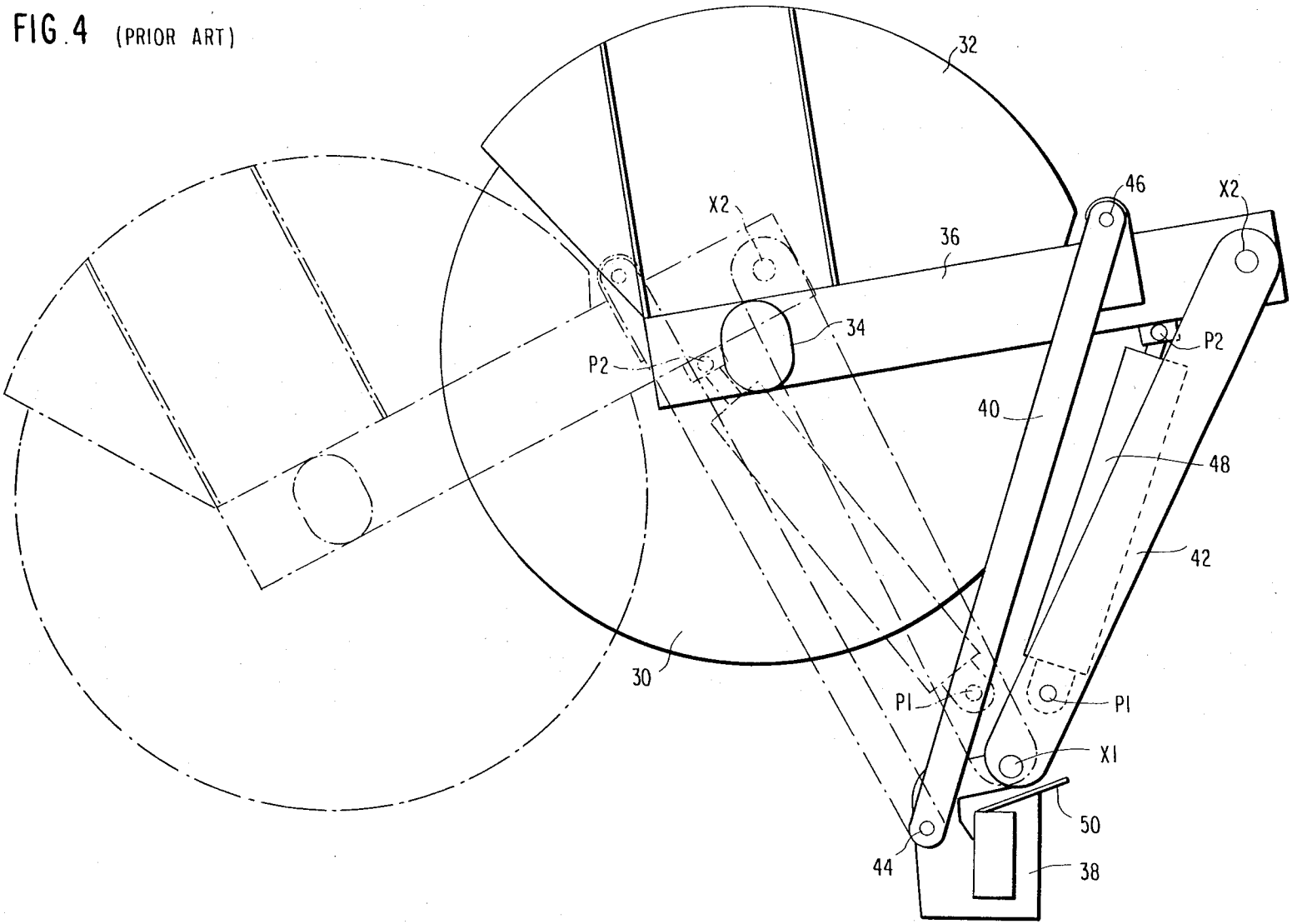
FIG. 4 (PRIOR ART)
FIG. 4 is an elevational view of a prior art saw boom control assembly in the fully retracted saw position with the fully extended saw position shown in dashed lines.

With reference to FIG. 4 where an exemplary prior art linkage is illustrated, the saw 30 is shown encased in the shield 32 and supported by a saw boom 36 to which the hydraulic motor 34 may be mounted.

In the fully retracted position on the right hand side of the figure as illustrated in solid lines in FIG. 4, the saw boom 36 and the base 38 provide opposite two sides of a linkage generally in the form of a parallelogram. The other two sides of the parallelogram boom are formed by a forward arm 40 and a rearward arm 42. As illustrated in FIG. 4, the forward arm 40 is pivotable from the base 38 about a point 44 and about a point 46 on the boom 36. Similarly, the rearward arm 42 is pivotable about a point $X_1$ on the base 38 and about a point $X_2$ on the saw boom.

Power for the movement of the saw laterally across the trailer bed in the cutting operation may be provided by any suitable conventional double acting hydraulic cylinder/piston 48 connected respectively for pivotable movement about points $P_1$ on the rearward arm 42 and about point $P_2$ on the saw boom 36.

With continued reference to FIG. 4, the known prior device is shown in dashed lines in the fully extended saw position.

Figure 5:
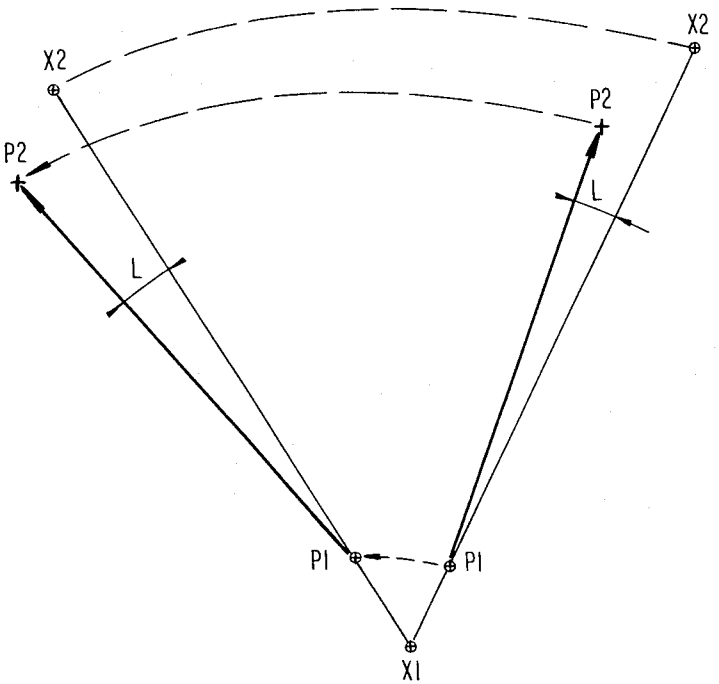
FIG. 5 (PRIOR ART)
FIG. 5 is a plot illustrating the relative angle between the saw boom pivot arm and the direction of the application of power to the linkage of FIG. 4 in both the fully retracted and fully extended saw positions.

With reference to FIG. 5, the points $X_1$ and $X_2$ about which the rearward arm 42 pivots are shown in both the fully retracted saw position on the right-hand side of the figure and in the fully extended saw position on the left-hand side of the figure. Similarly, the points $P_1$ and $P_2$ illustrating the direction of the application of power are shown in the fully retracted saw positon (right-side) and fully extended saw positon (left-side). As shown in the right hand side of FIG. 5, the angle L formed by the intersection of the lines $X_1$–$X_2$ and $P_1$–$P_2$ is an acute angle of less than about ten degrees in the fully retracted saw position. Similarly, the angle L formed by the lines $X_1$–$X_2$ and $P_1$–$P_2$ with the saw in the fully extended saw position is an acute angle of less than about ten degrees.

Figure 8:
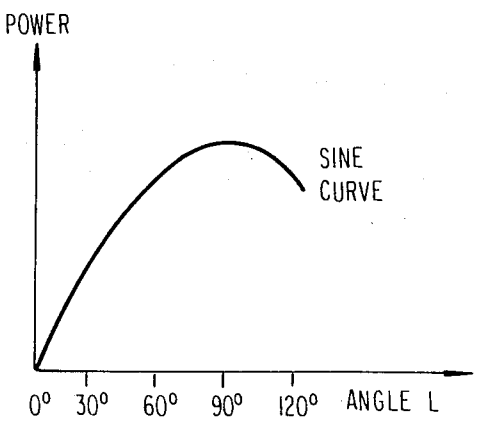
FIG. 8 is a graph illustrating the percentage of power applied as a function of the angle L between the saw boom pivot arm and the direction of the application of power.

As illustrated in FIG. 8, the proportion or percentage of the power available from the hydraulic cylinder/piston 48 is a function of the angle L and follows a sinusoidal function with maximum power at an angle L of ninety degress. As is illustrated in FIG. 8, a reduction in the angle L diminishes the power of the cylinder/piston 48 available for control of saw boom movement.

To compensate for this substantial reduction in power adjacent the fully retracted and fully extended saw positions, and in particular to deal with an intermediate position spaced from but adjacent to the fully retracted saw position in which the piston is essentially vertical and the angle L approaches zero degrees, a suitable spring biasing means 50 is generally provided. This spring bias is desirable to prevent the complete loss of control of the saw boom in the angle L equals zero degrees position.

The disadvantages associated with an angle L near zero degrees includes not only the tendency of the saw to remain in that position and out of the control of the operator, but also the uncontrolled acceleration of the saw to the left in FIG. 4 as it passes through that position. If the saw blade accelerates too rapidly to the left during the initial cutting operation, the saw will have a tendency to "buck" or to stall as a result of the excessive rate of feed into the log being cut.

Figure 6:
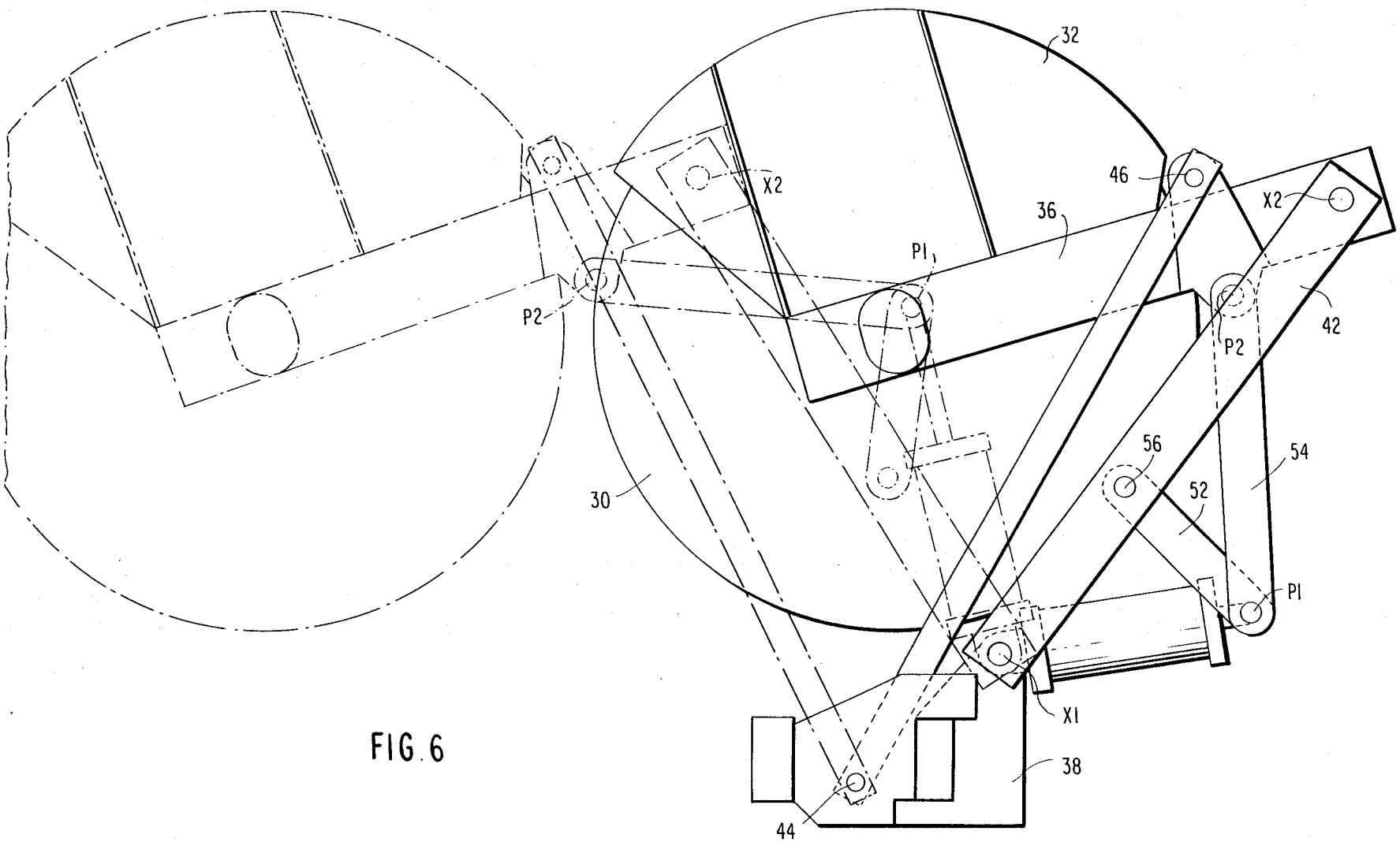
FIG. 6 is an elevational view of a saw boom control assembly in the fully retracted saw position with the fully extended saw position shown in dashed lines.

With reference now to FIG. 6 where a preferred embodiment of the linkage of the present invention is illustrated, the saw 30 with its shield 32 and boom 36 are illustrated in solid lines in the fully retracted saw position. In the fully retracted position, the forward arm 40 is pivotable about a point 44 on the base 38 and about point 46 on the saw boom 36. The rear arm 42 is pivotable about a point $X_1$ on the base 38 and about a point $X_2$ on the boom 36.

Note that the hydraulic cylinder/piston 48 is pivotably connected between point $X_1$ and point $P_1$ which serves as the interconnection between a first power linkage arm 52 and a second power linkage arm 54. The other end of the first power linkage arm 52 is pivotably connected at point 56 on the rear arm 42 and the other end of the second power linkage 54 is pivotably connected at a point $P_2$ on the boom 36. The effect of the power linkage arm 52 is to space point $P_2$ from the longitudinal axis of the rearward arm 42, i.e., the line drawn between points $X_1$ and $X_2$, and to thus change the angle to line $X_1$–$X_2$ made by the line of power application, i.e., line $P_1$–$P_2$.

The effects of the power linkage arm 52 on the movement of the boom 36 are also illustrated in the dashed lines in FIG. 6 which indicate the fully extended position of the saw.

Figure 7:
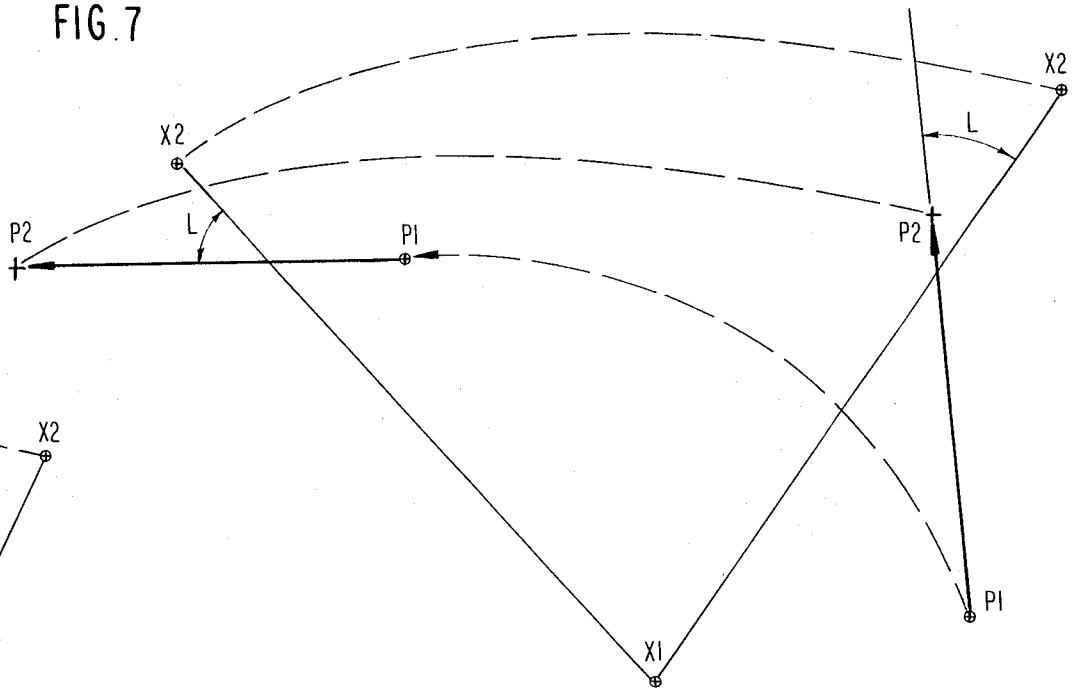
FIG. 7 is a plot illustrating the relative angle between the saw boom pivot arm and the direction of the application of power to the linkage, of FIG. 6 in both the fully retracted and fully extended positions.

As shown in FIG. 7, the angle L between the lines $X_1$–$X_2$ and $P_1$–$P_2$ in the fully retracted position illustrated on the lefthand side of the figure remains at acute angle. However, as is readily apparent from a comparison of FIGS. 5 and 7, the angle L in FIG. 7 is substantially larger than that of FIG. 5. Thus angle L is desirably in the neighborhood of thirty-forty degrees. Similarly, the angle L between the lines $X_1$–$X_2$ and $P_1$–$P_2$ on the left hand side of FIG. 7 representative of the fully extended position of the saw is an acute angle. However, the angle L in the fully extended position is also clearly substantially greater than the angle L in the comparable position in FIG. 5, and desirably about thirty-forty degrees.

More importantly, the movement of the point $P_1$ in FIG. 7 is not concentric about point $X_1$ as is the movement of point $P_1$ in FIG. 5. As a result, the angle L in the linkage illustrated in FIG. 7 is never less than about ten degrees (preferably thirty degrees) and the positive control problems associated with an angle L approximating zero degrees are thus avoided. By maintaining a large angle L, the power available for control of the saw blade position is substantially increased.

While preferred embodiments of the present invention have been described, it is to be understood that the embodiments described are illustrative only and that the scope of the invention is to be defined solely by the appended claims when accorded a full range of equivalents, many variations and modifications naturally occurring to those skilled in the art from a perusal hereof.

What is claimed is:

1. A mobile radial arm timber saw comprising:

a trailer bed with a plurality of ground engaging wheels, said trailer bed being adapted to support a log thereon;

a saw boom;

a pivot arm pivotably connected to said trailer bed and to said saw boom for pivoting said saw boom from a fully retracted saw position adjacent one lateral side of said trailer bed to a fully extended saw position adjacent the other side of said trailer bed;

means carried by said trailer bed for limiting the lateral movement of a log away from the fully retracted saw boom side of said trailer bed when supported by said trailer bed; and means pivotably connected to said trailer bed and to said saw boom for selectively applying power to said saw boom at an angle to the longitudinal axis of said pivot arm, said angle being not less than about ten degrees at any point in the movement of said saw boom from the fully retracted saw position to the fully extended saw positon.

2. The saw of claim 1 wherein said angle is not less than about thirty degrees.

3. The saw of claim 1 wherein said angle is not less than about forty degrees.

4. The saw of claim 1 wherein said ground engaging wheels are four in number and located two each on opposite sides of said trailer bed, at least one of said wheels on one side of said trailer bed being offset longitudinally of said trailer bed with respect to both of the wheels on the other side of said trailer bed.

5. The saw of claim 1 wherein said power applying means includes:

a double acting hydraulic cylinder and piston;

a first power linkage; and a second power linkage, one end of each of said cylinder and piston and said first and second power linkages being pivotably interconnected, the other end of said cylinder and piston being pivotably connected to said trailer bed, the other end of said first pivot arm being pivotably connected to said pivot arm intermediate the length thereof, and the other end of said second pivot arm being pivotably connected to said saw boom.

6. A mobile radial arm timber saw comprising:

a trailer bed with a plurality of ground engaging wheels;

a saw boom adapted to carry a radial arm timber saw adjacent the forward end thereof;

a forward arm connected to said bed and to said boom for pivotable movement about first and second axes respectively;

a rear arm pivotably connected to said bed and to said boom for pivotable movement about third and fourth axes respectively;

said first axis being lower and forward of said third axis and said second axis being above and forward of said fourth axis;

first and second power linkages pivotably connected adjacent one end thereof, the other end of said first power linkage being pivotably connected to said rear arm intermediate the ends thereof and the other end of said second power linkage being connected to said boom for pivotable movement about a fifth axis intermediate the length thereof; and means for selectively varying the distance between said third axis and the interconnection of said first and second power linkages.

7. The saw of claim 6 wherein said second and fifth axes are laterally displaced on opposite sides of the longitudinal axis of said boom.

8. A mobile radial arm timber saw comprising:

a trailer bed adapted to support a log thereon;

a saw boom;

a pivot arm pivotably connected to said trailer bed and to said saw boom for pivoting said saw boom from a fully retracted saw position adjacent one lateral side of said trailer bed to a fully extended saw position adjacent the other side of said trailer bed;

means carried by said trailer bed for limiting the lateral movement of a log away from the fully retracted saw boom side of said trailer bed when supported by said trailer bed; and means pivotably connected to said trailer bed and to said saw boom for selectively maintaining positive control in positioning said saw boom with respect to said trailer bed at all points in the movement of said saw boom from the fully retracted saw position to the fully extended saw position, said saw position maintaining means including:

a double acting hydraulic cylinder and piston;

a first power linkage; and a second power linkage.

one end of each of said cylinder and piston and said first and second power linkage being pivotably interconnected, the other end of said cylinder and piston being pivotably connected to said trailer bed, the other end of said first power linkage being pivotably connected to said pivot arm intermediate the length thereof, the other end of said second power linkage being pivotably connected to said saw boom.

9. A mobile radial arm timber saw comprising:

a trailer bed adapted to support a log thereon;

a saw boom;

a pivot arm pivotably connected to said trailer bed and to said saw boom for pivoting said saw boom from a fully retracted saw position adjacent one lateral side of said trailer bed to a fully extended saw position adjacent the other side of said trailer bed;

means carried by said trailer bed for limiting the lateral movement of a log away from the fully retracted saw boom side of said trailer bed when supported by said trailer bed; and means pivotably connected to said trailer bed and to said saw boom for selectively maintaining positive control in positioning said saw boom with respect to said trailer bed at all points in the movement of said saw boom from the fully retracted saw position to the fully extended saw position, said saw position maintaining means including:

a forward arm connected to said trailer bed and to said boom for pivotable movement about first and second axes respectively;

a rear arm pivotably connected to said trailer bed and to said boom for pivotable movement about third and fourth axes respectively, said first axis being lower and forward of said third axis and said second axis being above and forward of said fourth axis;

first and second power linkages pivotably connected adjacent one end thereof, the other end of said first power linkage being pivotably connected to said rear arm intermediate the ends thereof and the other end of said second power linkage being connected to said boom for pivotable movement about a fifth axis intermediate the length thereof; and means for selectively varying the distance between said third axis and the interconnection of said first and second power linkages.

10. The saw of claim 9 wherein said second and fifth axes are laterally displaced on opposite sides of the longitudinal axis of said boom.

* * * * *